US005471809A

United States Patent [19]

Frankel

[11] Patent Number: 5,471,809

[45] Date of Patent: Dec. 5, 1995

[54] REINFORCED PLASTIC STRUCTURAL SUPPORT MEMBER

[76] Inventor: Arie Frankel, 7 Knights Hill Ct., Melville, N.Y. 11747

[21] Appl. No.: 189,584

[22] Filed: Jan. 31, 1994

[51] Int. Cl.[6] ..... E04C 3/30

[52] U.S. Cl. ..... 52/737.4; 52/730.4; 52/731.2; 52/309.1; 138/114; 138/149; 428/36.91

[58] Field of Search ..... 52/727, 728, 729, 52/730.4, 309.13, 309.14, 309.16, 731.2, 732, 309.1; 428/34.1, 34.5, 36.9, 36.91; 138/96 R, 116, 114, 104, 148, 149

[56] References Cited

U.S. PATENT DOCUMENTS

| | | | |
|---|---|---|---|
| 3,181,849 | 5/1965 | Mitchell | 52/727 |
| 3,196,583 | 7/1965 | Rex et al. | 411/922 |
| 3,631,789 | 1/1972 | Kinsey | 52/728 |
| 4,312,162 | 1/1982 | Medney | 52/309.16 |
| 4,585,681 | 4/1986 | Kidera et al. | 428/36.91 |
| 4,700,751 | 10/1987 | Fedrick | 138/114 |
| 4,977,722 | 12/1990 | Taylor | 52/730.4 |
| 5,217,771 | 6/1993 | Schmanski et al. | 428/36.9 |
| 5,238,716 | 8/1993 | Adachi | 428/39.91 |

*Primary Examiner*—Carl D. Friedman
*Assistant Examiner*—Winnie S. Yip
*Attorney, Agent, or Firm*—Gottlieb, Rackman & Reisman

[57] ABSTRACT

An elongated plastic support member for making various architectural frames is formed of an extruded hollow plastic element and a reinforcing element disposed inside and coextensive with the plastic element. The reinforcing element is sized and shaped to form an interference fit with an inner wall of the plastic element and may be made of metal.

16 Claims, 2 Drawing Sheets

REINFORCED PLASTIC STRUCTURAL SUPPORT MEMBER

BACKGROUND OF THE INVENTION a. Field of Invention

This invention pertains to structural members such as beams, and more particularly to a structural member formed of a tubular element made of a plastic material, and a reinforcing element disposed inside the tubular element.

b. Description of the Prior Art

Traditionally, straight structural members such as beams used as the basic element to form a support frame for an architectural structure have been made of either wood or of metal such as steel or aluminum. However because of environmental concerns, beams made out of wood are disfavored.

OBJECTIVES AND SUMMARY OF THE INVENTION

In view of the abovementioned disadvantages of the prior art, it is an objective of the present invention to provide a beam made of plastic materials which can be used as a structural member.

A further objective is to provide a structural member which is relatively light and easy to manufacture.

Another objective is to provide a beam which can be made of recycled materials and hence is environmentally preferable.

Other objectives and advantages of the invention shall become apparent form the following description. Briefly a structural support member constructed in accordance with this invention includes an outer tubular or hollow element made of a plastic material. A reinforcing element is disposed inside the tubular element forming an interference fit therewith. The reinforcing element is preferably made of steel.

DETAILED DESCRIPTION OF THE INVENTION

Figure 1:
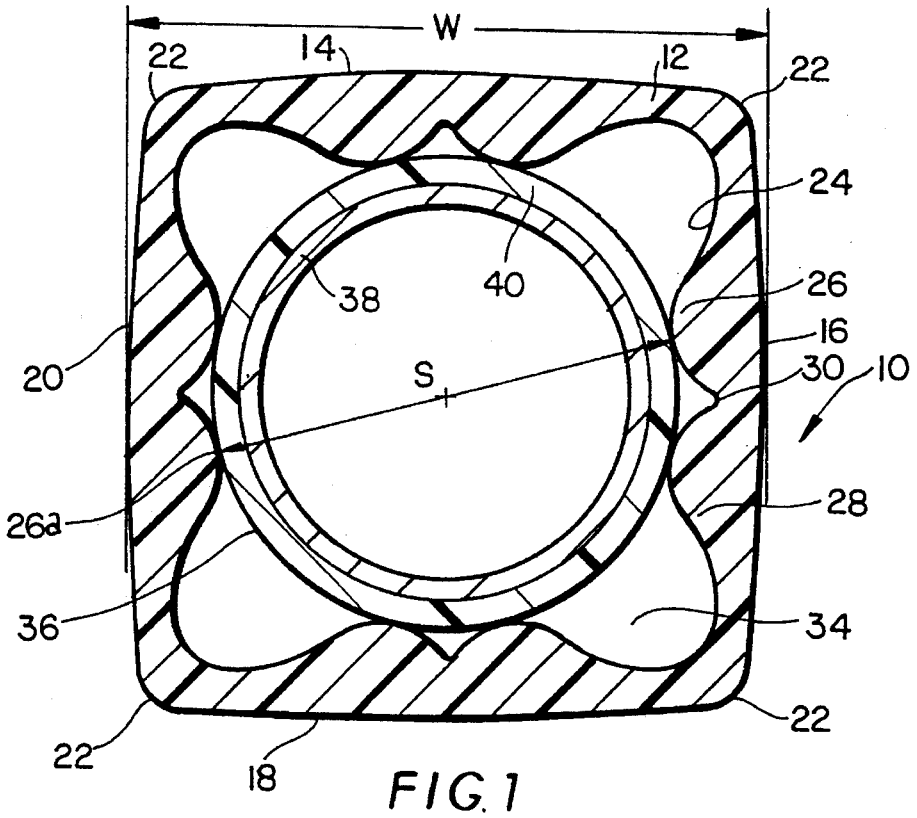
FIG. 1 shows a cross sectional view of a structural support member constructed in accordance with this invention.
Figure 2:
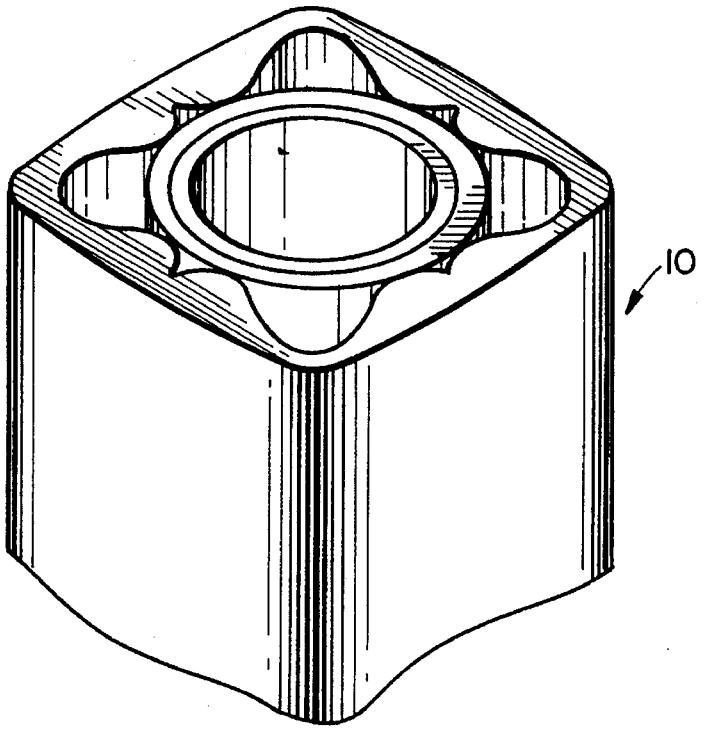
FIG. 2 shows a partial orthogonal view of the structural support member of FIG. 1.

Referring now to the Figures, and more particularly to FIGS. 1 and 2, a structural support member 10 constructed in accordance with this invention includes a tubular element 12. This element can have different cross sections. In the Figures element 12 has a generally square cross section defined by four outer side walls 14, 16, 18, 20 joined by rounded corners 22. As seen in FIG. 1, preferably side walls 14–20 are not planar but rather are somewhat curved so that they bulge outwardly. Each of the side walls 14–20 has an inner surface such as surface 24. This surface is formed with two longitudinally extending ribs 26, 28. These ribs have a generally rounded profile and are separated by a trough 30 disposed substantially along the median of surface 24. More particularly, as seen in FIG. 1, each rib 24, 26 is formed by gradually increasing the thickness of the respective wall 16 from a corner 22 to an intermediate contact point and then decreasing said thickness until the median of wall 24 is reached. The inner surface 24 defines with the other three inner surfaces a longitudinal space 34 inside element 12. Preferably element 12 is made of a plastic material such as HDP or HDP comingled with LDP, using an extrusion process. Advantageously, element 12 may be made of recycled materials such as plastic bottles and other plastic containers.

Disposed inside the tubular element 12, i.e. in space 34, is a reinforcing element 36. Element 36 extends longitudinally through outer tubular element 12 and is sized and shaped to form an interference fit with the inner surfaces of element 12. In the embodiment of FIGS. 1 and 2 reinforcing element 36 has a circular cross section with a diameter which exceeds slightly the spacing between the grooves on the inner surfaces of element 12. Because element 12 is made of a plastic material which is slightly flexible or malleable, as the element 36 is inserted into space 34 it causes the outer element 12 or at least its ribs 24, 26 to distort radially outwardly to form an interference fit to clamp and secure the reinforcing element 36. Element 36 may be formed of two telescoping components, a steel pipe 38 and a plastic sheath 40. The steel pipe is preferably a stock item having a standard outer diameter. The element 12 may have an outer width of about 3⅝" (92 mm) with a spacing S between a rib 26 and a diametrically opposed rib **26*a* not exceeding about 2¾" (70 mm). Therefore if a standard, off the shelf pipe 38 is used having a outer diameter 2⅜" (60 mm) and a thickness of about ⅛" (3 mm) the pipe 36 will not fit snugly inside space 34 but instead it will be loose and unattached. Therefore pipe 38 is provided with the sheath 40 as a spacer to insure that an interference fit is formed with element 12. For the dimension given above, sheath 40** has a radial thickness of about 3/16" (5 mm).

Figure 3:
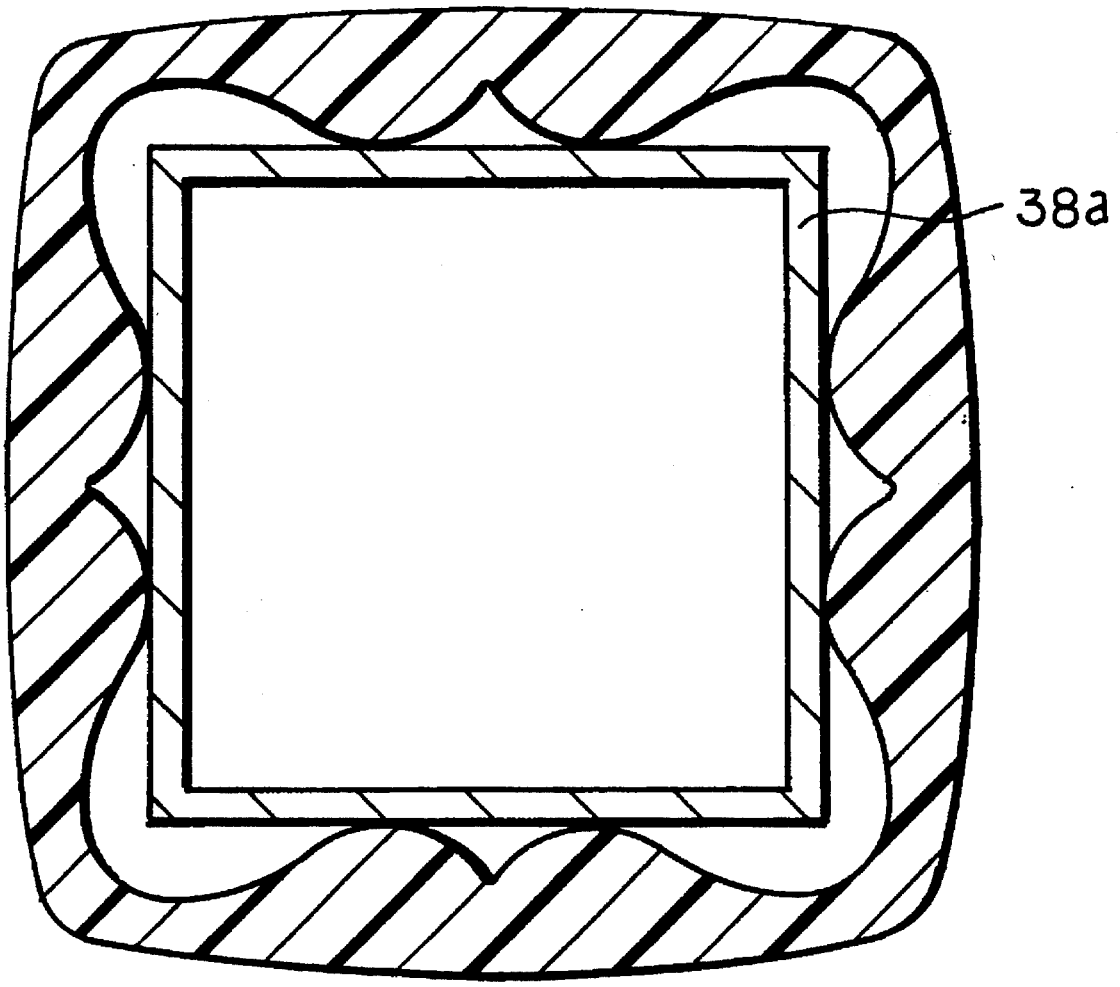
FIG. 3 shows a cross sectional view of an alternate embodiment of the invention.

A somewhat preferred embodiment of the invention is shown in FIG. 3. In this embodiment, reinforcing support member **10*a* is formed of an outer element 12 identical to element 10 in FIGS. 1 and 2 and a pipe 38*a* forming the reinforcing member. Pipe 38*a* has a square rather than a circular cross-section. The advantage of this support member over the member 12 shown in FIGS. 1 and 2 is that if a hole is drilled into the member 10, for example for installing some screws therein, the drill must be oriented precisely radially with respect to pipe 38, or the drill bit has tendencies to slip tangentially along pipe 38. This problem does not exist for the square pipe 38*a* of the embodiment in FIG. 3. In addition, a standard square pipe is available off the shelf which has the proper dimensions necessary to form an interference fit with the ribs 24, 26** and accordingly a plastic sleeve may not be required.

The structural member having the structure shown in FIGS. 1 and 2 or 3 can be made in standard lengths of eight, ten, twelve feet and so on. The reinforcing element insures that the member has better structural strength then a plastic member formed only a tubular plastic element. Once the structural members are delivered to a job site they are easily cut to size if required and assembled to form an architectural frame.

An important advantage of the present invention is that there is minimal contact area between the tubular element and the reinforcing element. Because the elements have different coefficients of expansion, they will expand and contract at different rates. However due to the minimal contact area between them, undue stresses due to the thermal expansions and contractors are avoided.

Numerous modifications may be made to this invention without departing from its scope as defined in the appended claims.

I claim:

1. A plastic support member which can be assembled to from a frame for an architectural structure comprising:

a plastic elongated load bearing element having a plurality of inner walls arranged to define a cavity, each wall having only two longitudinal contact ribs, said rib being disposed symmetrically about a median of the respective wall; and a reinforcing element disposed inside said cavity, said reinforcing element forming an interference fit with said ribs.

2. The member of claim 1 wherein said cavity has a generally square cross-section.

3. The member of claim 1 herein said reinforcing element is made of metal.

4. The member of claim 1 wherein said reinforcing element is a metal pipe.

5. The member of claim 1 wherein said reinforcing element is a circular pipe.

6. The member of claim 1 wherein said reinforcing element is a substantially square pipe.

7. The member of claim 1 wherein each rib has a curved cross-section.

8. The member of claim 1 wherein the two ribs form a trough therebetween disposed along said median.

9. A structural member for making an architectural frame, said structural member comprising;

an elongated plastic member having a plurality of external walls and a plurality of corresponding inner walls, each inner wall having only two longitudinal contact ribs disposed symmetrically about the median of the corresponding inner wall; and a reinforcing element disposed between said inner walls, said reinforcing element forming an interference fit with said ribs wherein said elongated plastic member includes corners, each said corner being defined by two adjacent inner walls, wherein each said rib is formed by increasing the thickness of said wall gradually from said corner to a contact point and then decreasing said thickness gradually, said interference fit being formed at said contact point.

10. The support member of claim 9 wherein said reinforcing element includes a tubular pipe.

11. The support member of claim 10 wherein said pipe has a circular cross section.

12. The support member of claim 10 wherein said pipe is covered by a plastic sheath forming a spacer between said pipe and said plastic element.

13. The support member of claim 10 wherein plastic element and said pipe have a square cross section.

14. The member of claim 9 wherein each rib has a curved cross-section.

15. The member of claim 9 wherein the two ribs form a trough therebetween disposed along said median.

16. A structural member for making an architectural frame, said structural member comprising:

an elongated plastic member having a plurality of external walls and a plurality of corresponding inner walls, each one of said inner wall having at least one longitudinal contact rib; and a reinforcing element disposed between said inner walls, said reinforcing element forming an interference fit with said rib;

wherein said plastic member further includes corners, each corner being defined by two adjacent walls, and wherein said rib is formed by increasing the thickness of said wall gradually from said corner to a contact point and then decreasing said thickness gradually, said interference fit being formed at said contact points.

* * * * *